US006571874B1

(12) United States Patent
Lovenich et al.

(10) Patent No.: US 6,571,874 B1
(45) Date of Patent: Jun. 3, 2003

(54) METHOD FOR THE IN-SITU EXTRACTION OF GAS FROM COAL SEAMS

(75) Inventors: Armin Lovenich, Alpen (DE); Hans-Joachim Doering, Ratingen (DE)

(73) Assignee: RAG Aktiengesellschaft (DE)

( * ) Notice: Subject to any disclaimer, the term of this patent is extended or adjusted under 35 U.S.C. 154(b) by 0 days.

(21) Appl. No.: 09/786,488

(22) PCT Filed: Aug. 27, 1999

(86) PCT No.: PCT/DE99/02693

§ 371 (c)(1), (2), (4) Date: May 30, 2001

(87) PCT Pub. No.: WO00/14379

PCT Pub. Date: Mar. 16, 2000

(30) Foreign Application Priority Data

Sep. 2, 1998 (DE) ..... 198 39 866

(51) Int. Cl.[7] ..... E21B 47/00
(52) U.S. Cl. ..... 166/263; 166/275
(58) Field of Search ..... 166/263, 271, 166/280, 308; 405/129.35, 129.4

(56) References Cited

U.S. PATENT DOCUMENTS 3,794,116 A * 2/1974 Higgins ..... 166/259
5,014,788 A 5/1991 Puri et al.
5,388,640 A * 2/1995 Puri et al. ..... 166/263
5,388,643 A * 2/1995 Yee et al. ..... 166/266
5,411,098 A 5/1995 Schmidt et al.
5,494,108 A * 2/1996 Palmer et al. ..... 166/308
5,566,755 A 10/1996 Seidle et al.
6,119,778 A * 9/2000 Seidle et al. ..... 166/263
6,412,559 B1 * 7/2002 Gunter et al. ..... 166/271

OTHER PUBLICATIONS

Measurement of "Rock Properties" in Coal for Coalbed Methane Production—journal article.

* cited by examiner

*Primary Examiner*—Frank Tsay
(74) *Attorney, Agent, or Firm*—R W Becker & Associates; R W Becker

(57) ABSTRACT

A method for the in-situ extraction of gas from coal seams is provided. Flow paths are produced in gas-containing coal by opening up the structure of the coal by introducing into a bore hole that is sunk into the coal at least one gas and/or liquid under pressure over a prolonged period of time at a pressure that is less than the lowest principal stress determined in a respective seam layer from which gas is to be extracted. The introduction into the bore hole is carried out with a cyclically fluctuating pressure. Gas is subsequently extracted via the bore hole.

7 Claims, No Drawings

METHOD FOR THE IN-SITU EXTRACTION OF GAS FROM COAL SEAMS

BACKGROUND OF THE INVENTION

The present invention relates to a method for the in-situ extraction of gas from coal seams, whereby to provide flow paths in the coal, the structure of the gas-containing coal is opened up by means of gases and/or liquids introduced under pressure into a bore hole that is sunk into the coal seam, and subsequently applying to the bore, for the gas extraction, a pressure that is less than the respective desorption pressure.

The recovery possibility of methane that is present in coal seams from coal layers not opened up by miners by means of an in-situ extraction from bore holes sunk into the pertaining coal seam is determined by the parameters of gas content, permeability, and porosity of the coal, as well as by the desorption pressure of the methane, which is a function particularly of the gas content of the coal. To extract the methane, in connection with heretofore known methods stimulation techniques have been used that are known from petroleum extraction; in this connection, the bore hole that is sunk into the coal seam from which gas is to be extracted is briefly, i.e. over a time period of less than one hour up to a few hours, subjected to a uniformly high pressure, for example from 300 to 350 bar, by means of injection of water or a suitable gas.

This pressurization leads to the formation of a so-called frac, or formation fracturing, by means of which the macro structure of the coal is broken up along its natural mechanical weak points, such as clefts, fissures, etc. The pressurization takes place accompanied by the simultaneous introduction of a suitable material, for example a loose sand, by means of which the opened-up macro structure is kept open and simultaneously a gas stream path is produced along the broken-up mechanical weak points. With the known methods, to this extent merely the acess surface into the extraction bore hole is enlarged.

The known stimulation methods have the drawback that with them it is possible to achieve satisfactory gas extraction rates in coal seams having a low permeability only if the coal is highly saturated with methane and consequently the desorption pressure is relatively close to the pressurization pressure. In contrast, if a low permeable coal is under saturated, there results, proceeding from the respectively introduced frac, only a low penetration depth of the pressure flare or funnel that is established upon reducing the pressure for the gas extraction. The extraction pressure that is to be established below the desorption pressure at the bore hole therefore acts only upon a relatively small volume of coal, namely that which exists directly perpendicular to the respective frac. Thus, the known stimulation technique affects only relatively small seam sections; there occurs at least over a short period of time no volumetric seam effect, and the migration speed of the pressure drop in the seam during the extraction operation is too low.

Consequently, with a low permeability and a low desorption pressure of the coal from which gas is to be extracted, the time period for dropping below the desorption pressure in an economically interesting coal volume is correspondingly long; the gas extraction rates that can be achieved can then be so low that there is no economical gas extraction.

It is therefore an object of the present invention to provide a method of the aforementioned general type by means of which the gas extraction rates can be increased.

SUMMARY OF THE INVENTION

The realization of this object, including advantageous embodiments and modifications of the invention, can be seen from the content of the patent claims that follow this description.

The basic concept of the present invention is that to open up the coal, pressurization of the bore hole that is effective over a prolonged period of time is established with a pressure that is less than the lowest principal stress determined in the respective seam layer from which gas is to be extracted, whereby the pressurization of the bore hole is effected during the opening-up time period with a cyclically fluctuating pressure.

DESCRIPTION OF PREFERRED EMBODIMENTS

The present invention has the advantage that the pressurization of the coal seam from which gas is to be extracted with a pressure that is less than the lowest principal stress determined in the seam in question opens the complex fissure system present in the coal in the pore range of macro pores up to micro pore structures, without new fissures in the range of the macro structure opening or having to open. Subsequent to the opening-up of the pore structure, the micro fissures do not return to their tight or impermeable starting position since due to the longer lasting pressurization with a pressure that is in the range of the principal stress, a low dislocation of the micro fissure surfaces relative to one another is produced, and due to the separation of very fine particles connected therewith, a permanent gap is generated on the respective fissure surface, so that advantageously it is also possible to eliminate the use of support material such as sand, etc.

The opening of the fissure system in the pore range is furthermore enhanced pursuant to the present invention by pressurizing the bore hole during the opening-up time period with a cyclically fluctuating pressure, so that in so doing there results a kind of breathing in the pore range of the coal that is to be opened up, as a result of which once pore structures have opened they cannot close again. This also enhances the shifting of the micro fissure surfaces relative to one another, and the transport of loosened very fine particles within the opened micro pore structures.

Thus, with the inventive method the permeability of the coal is permanently increased over a larger surface area without, during the subsequent extraction operation, having to pump a larger volume of coal to a pressure level below the desorption pressure, so that this larger coal volume, having the permeability increased by the inventive measures, is available for gas extraction.

To determine the pressure that is to established in individual cases, the lowest principal stress that exists in the coal seam from which gas is to be extracted is measured, and the pressurization pressure is set lower than the determined principal stress; the pressurization takes place over a prolonged period of time that is measured in terms of one day up to many days or weeks. This long-lasting pressurization with the pressure that is a function of the given principal stress leads to the desired opening-up of the pore structure of the coal without alterations in the mechanical structure of the coal seam developing.

Pursuant to one specific embodiment of the present invention, during the opening-up time period, periods of pressurization of the bore hole can cyclically alternate with periods of gas extraction.

Pursuant to specific embodiments of the present invention, the pressurization of the bore hole can be effected by pressing water or gas in. To the extent that water is used for pressurization of the bore hole, seam water that is present at the site can be pressed into the bore hole, or by means of cyclically applied pressure the breathing of the pore structure can be produced via the pressure inducement of the seam water. In the same way, pursuant to another specific embodiment of the present invention, the gas that flows to the bore hole and is extracted can be pressed back into the bore hole for the pressurization thereof; alternatively, it is also possible to press in $CO_2$, which has the advantageous effect that during the entry of $CO_2$, the affinity of the methane ($CH_4$) that is to be extracted to the coal is reduced, so that the $CO_2$ gas that is utilized for the pressurization at the same time acts as an extraction aid.

The features of the subject matter of these documents disclosed in the preceding description, the patent claims and the abstract can be important individually as well as in any combination for realizing the invention in its various embodiments.

The specification incorporates by reference the disclosure of German priority documents 198 39 866.2 of Sep. 2, 1998 and PCT/DE99/02693 of Aug. 27, 1999.

The present invention is, of course, in no way restricted to the specific disclosure of the specification and drawings, but also encompasses any modifications within the scope of the appended claims.

What is claimed is:

1. A method for the in-situ extraction of gas from coal seams, said method including the steps of:

producing flow paths in gas-containing coal by opening up the structure of said coal by introducing under pressure into a bore hole that is sunk into said coal at least one of at least one gas and at least one liquid over a prolonged period of time at a pressure that is less than the lowest principal stress determined in a respective seam layer from which gas is to be extracted;

carrying out said introduction into a bore hole with a cyclically fluctuating pressure; and subsequently extracting gas via said bore hole.

2. A method according to claim 1, wherein during said opening-up period of time, periods of pressurization of said bore hole are cyclically alternated with periods of gas extraction.

3. A method according to claim 1, wherein pressurization of said bore hole is carried out by pressing in water.

4. A method according to claim 3, wherein seam water that is present at the site is pressed in as said water.

5. A method according to claim 1, wherein pressurization of said bore hole is carried out by pressing gas.

6. A method according to claim 5, wherein gas that is to be extracted and that flows into said bore hole is utilized for pressurizing said bore hole and is pressed back into the bore hole.

7. A method according to claim 5, wherein $CO_2$ is pressed into said bore hole as said gas.

* * * * *